US005343587A

United States Patent [19]

Findley

[11] Patent Number: 5,343,587

[45] Date of Patent: Sep. 6, 1994

[54] MOP CONSTRUCTION INCLUDING DETACHABLE FABRIC CLEANING ELEMENT

[76] Inventor: Mary L. Findley, 1370 Bond La., Eugene, Oreg. 97401

[21] Appl. No.: 79,227

[22] Filed: Jun. 17, 1993

Related U.S. Application Data

[63] Continuation of Ser. No. 646,101, Jan. 24, 1991, abandoned.

[51] Int. Cl.[5] ..... A47L 13/24; A47L 13/46

[52] U.S. Cl. ..... 15/228; 15/144.4; 15/147.2; 15/23.1

[58] Field of Search ..... 15/98, 144 B, 147 R, 15/147 A, 147 B, 148, 227, 228, 229.1, 229.2, 229.3, 229.4, 231, 232, 235, 244.1, 244.3, 247

[56] References Cited

U.S. PATENT DOCUMENTS

| | | | |
|---|---|---|---|
| 815,343 | 3/1906 | Garnet | 15/228 |
| 2,301,586 | 11/1942 | Rubin | 15/247 X |
| 2,756,449 | 7/1956 | Dewey | 15/235 X |
| 2,815,521 | 12/1957 | Winckler | 15/247 X |
| 2,875,463 | 3/1959 | Minerley | 15/228 X |
| 2,896,240 | 7/1959 | Racine | 15/148 |
| 3,012,264 | 12/1961 | Nash | 15/247 X |
| 3,376,595 | 4/1968 | Cole | 15/118 X |
| 3,792,505 | 2/1974 | Saltzstein | 15/147 A X |
| 4,047,260 | 9/1977 | Deutsch et al. | 15/147 A |
| 4,580,307 | 4/1986 | Moss | 15/147 R |
| 4,685,167 | 8/1987 | Murray | 15/228 |
| 4,794,663 | 1/1989 | Vosbikian | 15/229 |
| 4,845,800 | 7/1989 | Pederson et al. . | |
| 4,852,210 | 8/1989 | Krajicek | 15/228 |
| 4,858,267 | 8/1989 | Unger | 15/235 X |
| 4,875,246 | 10/1989 | MacGregor | 15/98 |
| 4,945,599 | 8/1990 | Flynn | 15/244 |
| 4,982,472 | 1/1991 | Lustofin | 15/244.1 |

*Primary Examiner*—Timothy F. Simone
*Assistant Examiner*—Charles Cooley
*Attorney, Agent, or Firm*—Alexander Robb

[57] ABSTRACT

An improved mop construction includes a mop handle with an extendable handle portion, a mop head attached to the mop handle to form a rigid T shape, and a cushion layer enclosing the mop head. Strips of VELCRO® hook material are attached to a portion of the outer surface of the cushion layer in contact with the area to be cleaned. A loop fabric cleaning element such as a household towel or rag or other loop material surrounds the cushion layer and is secured thereto by engagement with the VELCRO® hook material.

12 Claims, 2 Drawing Sheets

MOP CONSTRUCTION INCLUDING DETACHABLE FABRIC CLEANING ELEMENT

This application is a continuation of application Ser. No. 07/646,101, filed Jan. 24, 1991, now abandoned.

BACKGROUND OF THE INVENTION

This invention relates generally to a new and improved mop construction in which a fabric cleaning element is easily attached to a mop head for cleaning floors or the like and easily detached from the mop head for laundering once the fabric cleaning element has become soiled.

Conventional rag mops used for dusting and wet mopping have a cleaning element that comprises strands or fibers of cotton, polyester, or other absorbent material. Although many rag mops have cleaning elements that can be detached for laundering, such cleaning elements have a tendency to fall apart after frequent laundering. Conventional sponge mops have a cleaning element that is typically a block of sponge material used as a scrubbing pad. The sponge scrubbing pad does not rinse completely clean and can crumble after only a few uses.

What is desired is a mop construction that is adapted to use a durable and absorbent fabric cleaning element such a household towel or rag, in order that the fabric cleaning element can be easily removed for rinsing or laundering.

SUMMARY OF THE INVENTION

It is therefore an object of the present invention to provide a mop construction having a fabric cleaning element that is easily attached to the mop head for effective cleaning of floors or other surfaces.

It is another object of the present invention to provide a mop construction having a fabric cleaning element that is easily removed from the mop head such that the cleaning element can be thoroughly and repeatedly cleaned by rinsing or laundering.

These and other objects, features, and advantages of the present invention are apparent to those skilled in the art from the following detailed description which proceeds with reference to the accompanying drawing figures.

According to the present invention, an improved mop construction includes a mop handle, a mop head attached to the mop handle to form a rigid T shape, and a cushion layer enclosing the mop head. Strips of VELCRO ® hook material are attached to a portion of the outer surface of the cushion layer in contact with the area to be cleaned. A loop fabric cleaning element such as a household towel or rag or other loop material surrounds the cushion layer and is secured thereto by engagement with the VELCRO ® hook material. In a preferred embodiment, the mop construction includes an extendable handle portion.

The mop construction of the present invention is economical to make and simple to use. The mop head does not require any moving parts. Since the mop head is enclosed in a cushion layer and further enclosed by a towel, the are no exposed metal structures or corners that could scratch flooring or moldings.

DETAILED DESCRIPTION OF THE INVENTION

Figure 1:
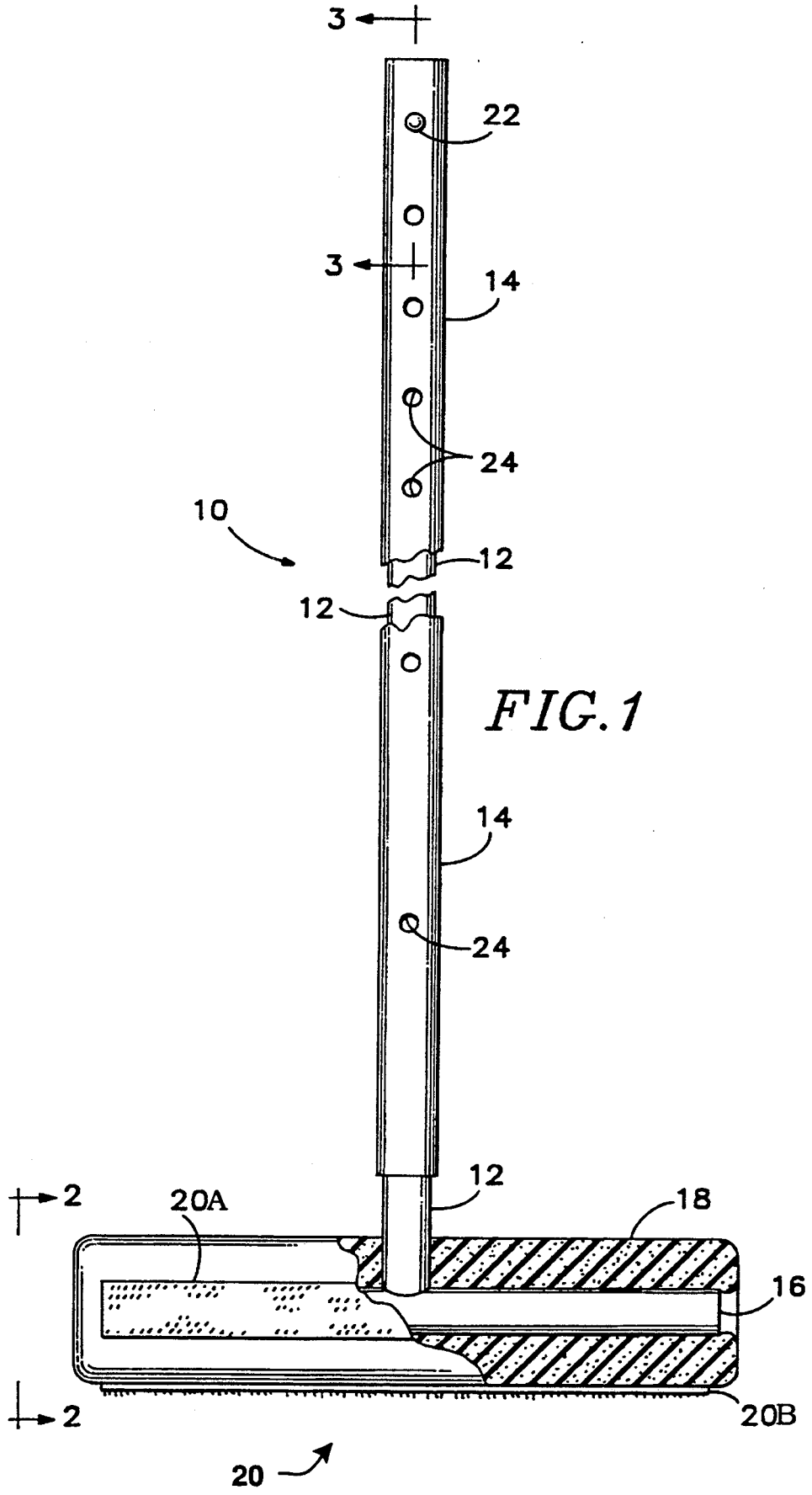
FIG. 1 is a front elevation of the mop construction according to the present invention with a portion of the mop head being cut away.

An improved mop construction 10 is shown in FIG. 1 including a mop handle 12, a mop head 16 attached to the mop handle to form a rigid T shape, and a cushion layer 18 enclosing the mop head 16. A zone of VELCRO ® hook material 20 (seen in the view of FIG. 1 as including hook material strips 20A and 20B) is attached to the outer surface of the cushion layer 18, at least a portion of the hook material zone being attached to a work surface of the cushion layer 18. The work surface is defined generally as that portion of the cushion layer 18 in contact with the surface to be cleaned. The extent of the work surface is thus approximately 180 degrees of the surface of the cushion layer 18 that faces away from the handle 12. Arc 30 shown in FIG. 2 best illustrates the extent of the work surface. A loop fabric cleaning element 28 (not shown in FIG. 1 and best seen in FIG. 4) surrounds the cushion layer 18 and is secured thereto by direct engagement with the hook material zone. The mop construction 10 also includes an optional extendable handle portion 14 for increasing overall length.

Figure 2:
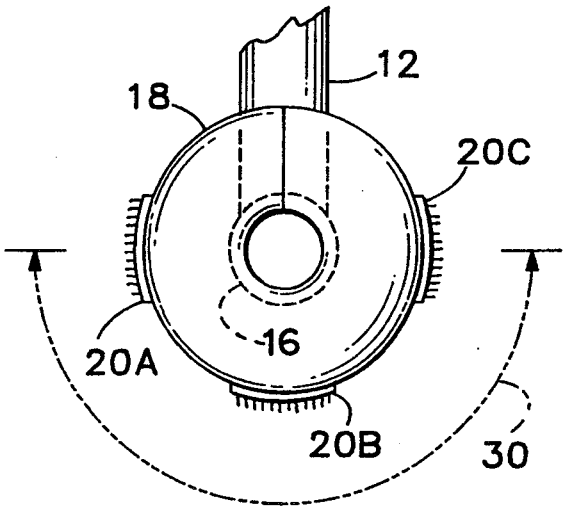
FIG. 2 is an end view of the mop head and surrounding cushion layer taken along line 2—2 of FIG. 1.

Further detail of the mop construction 10 is shown in the side view of FIG. 2. In a preferred embodiment, the cushion layer 18 has a generally tubular shape. The inner surface of cushion layer 18 substantially conforms to the outer surface of the mop head 16. The outer surface of the cushion layer 18 is substantially cylindrical, although other geometries can be used. The cushion layer 18 can be formed directly on the mop head 16. In the alternative, the cushion layer 18 can be formed separately. If formed separately, cushion layer 18 must be slit along the length, and a central hole created for conforming and fitting to mop head 16 and mop handle 12. Regardless of forming method, cushion layer 18 completely encloses mop head 16.

The cushion layer 18 is ideally comprised of sponge rubber, polystyrene pipe insulation, closed or open cell foam, or any other flexible cushioning materials. The outer surface of the cushion layer 18 can be coated with a impermeable film such as vinyl latex to prevent stripping solutions or wax from being absorbed. In the alternative, a separate, impermeable film layer such as 16 gauge plastic can be affixed to the outer surface of cushion layer 18.

Further detail of the zone of hook material 20 is shown in FIG. 2. Zone 20 is attached to the outer surface of cushion layer 18 by gluing or any other permanent, water-resistant attaching method. Zone 20 preferably includes first, second, and third VELCRO ® hook material strips 20A, 20B, and 20C extending in a parallel, angularly spaced relationship lengthwise along cushion layer 18. The first strip 20A is attached to a front portion of the outer surface of the cushion layer 18 at about 90 degrees from mop handle 12. The second strip 20B is attached to a bottom portion of the outer surface of the cushion layer 18 at about 180 degrees opposite from mop handle 12. The third strip 20C is attached to a rear portion of the outer surface of the cushion layer 18 at about 180 degrees opposite from the first strip 20A. The first, second, and third hook material strips 20A–C can be of any suitable type having upstanding hooks for engaging with corresponding loops. Other patterns of strips 20A–C can be used, indeed the entire outer surface of cushion layer 18 can be covered, but the foregoing strip pattern is advantageous for securing the cleaning element 28 while being economical.

Figure 4:
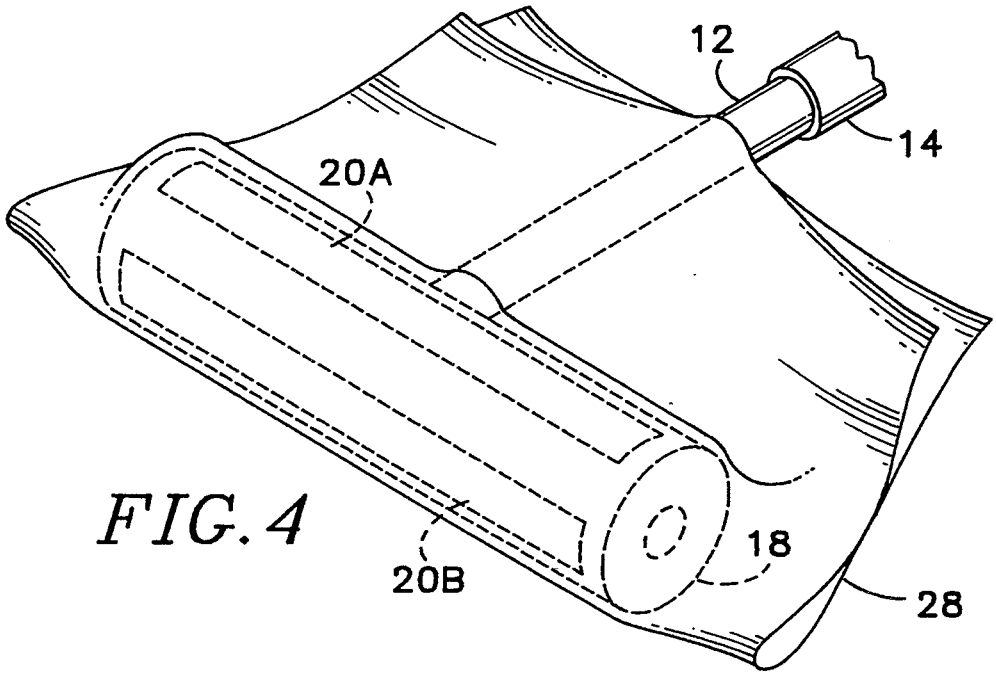
FIG. 4 is a perspective view of the mop construction of FIGS. 1–3 including a fabric cleaning element attached according to the present invention.

A cleaning element 28 suitable for attaching to the VELCRO® strips 20A–C is shown in FIG. 4. Cleaning element 28 is ideally an absorbent loop fabric such as a household towel or rag of cotton, polyester, blended, or any other fabric having a multiplicity of loops at the surface. Cleaning element 28 can also be specifically sized to and supplied with the mop construction 10. The weight of the cleaning element 28 can be varied. For example, a light weight terry cloth towel can be used for stripping, waxing, or sealing floors since less liquid is absorbed and wasted in the cleaning element 28. A heavier weight towel can be used to absorb liquid, such as in mopping up a spill.

In the preferred embodiment, mop handle 12, and mop head 16 are each tubular cylindrical members. The mop handle 12 and mop head 16 can be fabricated from aluminum, plastic, fiberglass, or other suitably rigid materials. The mop head 16 is securely fastened to the mop handle 12 by gluing, welding, brazing, bracketing, riveting, or other suitable fastening methods. The mop head 16 and mop handle 12 can also be formed together as one rigid T shaped piece. In the alternative, mop head 16 can have a central threaded hole or mounting portion for receiving a conventional mop handle from an existing mop. If desired, the ends of the mop head can be sealed or capped with plastic caps.

Figure 3:
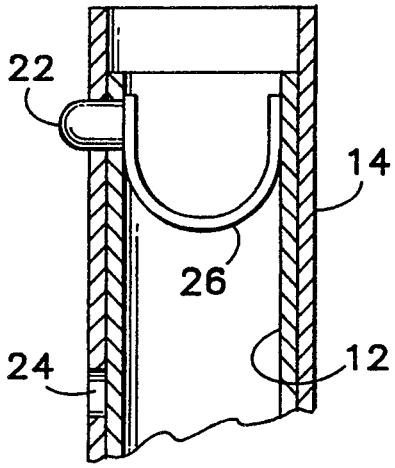
FIG. 3 is a sectional view of the mop handle and extendable handle portion taken along line 3—3 of FIG. 1.

The mop handle 12 includes a spring loaded button 22 and the extendable handle portion 14 includes a plurality of holes 24 for selectively engaging the spring loaded button 22. The extendable handle portion 14 is shown in FIG. 1 and in greater detail in FIG. 3. In FIG. 3, the spring loaded button 22 is shown extending through a hole in the handle 12 and secured in place by a spring 26 attached to an inner surface of the handle 12. For multiple length settings up to seven feet in total length, a plurality of holes 24 are located at regular intervals along the length of the extendable handle portion 14. In the extended position, the mop construction 10 can easily be used for cleaning or dusting ceilings or other hard to reach surfaces.

In operation, the fabric cleaning element 28 is easily secured, by direct contact with the zone of hook material 20, to the cushion layer 18 for effective cleaning (such as dusting or wet mopping), stripping, sealing, and waxing of hard surface flooring. A perspective view of the cleaning element attached to the mop construction is shown in FIG. 4. The cleaning element 28 is centered about the bottom of the cushion layer 18. The center of the cleaning element is directly secured to the second VELCRO® strip 20B. The other halves of the cleaning element 28 are wrapped around the cushion layer 18, being directly secured by VELCRO® strips 20A and 20C. Thus, the loops in the fabric of cleaning element 28 secure cleaning element 28 to the corresponding hooks in VELCRO® strips 20A–C. No additional means intervene between the loops of cleaning element 28 and the hooks of strips 20A–C.

In this position, the cleaning element 28 is securely fastened to the mop construction along the work surface for effective scrubbing and cleaning. The lengthwise end portions of the cleaning element 28 not secured by any of the VELCRO® strips 20A–C are folded over the front of the mop construction 10, or trail behind the mop. The widthwise portions of cleaning element 28 extending beyond the mop head 16 overlap and cover the end portions of the mop head 16 and the cushion layer 18. Therefore, mop construction 10 can be used to clean vertical surfaces such as baseboards or the like, while simultaneously cleaning horizontal surfaces.

Once the cleaning element 28 is soiled it can be repositioned on the cushion layer 18 or turned over to expose a clean portion or to prevent excessive wear. The cleaning element 28 is also easily removed for a thorough rinsing or laundering. Since cleaning element 28 is completely detachable, rinsing is more easily accomplished. And since cleaning element 28 is desirably a durable fabric such as a household towel or rag, it can be laundered repeatedly without falling apart or crumbling.

Although the preferred embodiment of the invention has been described, it is contemplated that many changes in the exact shape of the mop construction components and selection of materials as well as other changes can be made without departing from the principles of the invention.

I claim:

1. An improved mop construction comprising:

a mop handle;

a mop head attached to said mop handle at an upper portion of said mop head to form a rigid "T" shape;

a nonabsorbent cushion layer completely enclosing said mop head, a portion of the outer surface of said cushion layer defining a work surface;

a hook material zone attached to the outer surface of said cushion layer, at least a portion of said hook material zone being attached to said work surface at a point substantially opposite the point of attachment of said mop handle; and an absorptive loop fabric cleaning element substantially surrounding said cushion layer and secured thereto solely by direct engagement with said hook material zone, said loop fabric cleaning element providing multiple simultaneously usable cleaning surfaces.

2. The improved mop construction of claim 1 wherein the mop head comprises a substantially cylindrical, tubular member.

3. The improved mop construction of claim 1 wherein the cushion layer comprises a tubular shape having an inner surface that substantially conforms to an outer surface of the mop head, said cushion layer having a substantially cylindrical outer surface.

4. The improved mop construction of claim 1 wherein the cushion layer comprises a layer of flexible, foam material.

5. The improved mop construction of claim 1 wherein the hook material zone comprises first, second, and third hook material strips.

6. The improved mop construction of claim 1 wherein said loop fabric cleaning element comprises a towel or rag.

7. A method for providing a mop with a cleaning element that is easily removed for laundering, the method comprising:

attaching a mop head to a mop handle at an upper portion of the mop head to form a rigid "T" shape;

completely enclosing said mop head with a nonabsorbent cushion layer, said cushion layer having an outer surface, a portion of said outer surface defining a work surface;

mounting a hook material zone on said outer surface of said cushion layer, at least a portion of said hook material zone being mounted on said outer surface at a point substantially opposite the point of attachment of said mop handle;

substantially surrounding said cushion layer with a loop fabric cleaning element; and securing said loop fabric cleaning element to said cushion layer solely by directly engaging said loops of said fabric cleaning element with said hook material zone.

8. The method of claim 7 further including the step of easily removing said loop fabric cleaning element for rinsing or laundering.

9. The method of claim 7 wherein the step of mounting said hook material zone on said outer surface of said cushion layer comprises providing first, second, and third hook material strips.

10. An improved mop construction comprising:

a mop handle;

a mop head including a connection means located at an upper portion of said mop head for attaching said mop head to said mop handle to form a rigid "T" shape;

a nonabsorbent tubular cushion layer for completely enclosing said mop head having an inner surface that substantially conforms to an outer surface of said mop head and having a substantially cylindrical outer surface; and first, second, and third hook material strips, the first strip being attached to a front portion of the outer surface of said cushion layer, the second strip being attached to a bottom portion of the outer surface of said cushion layer at a point substantially opposite said connection means, and the third strip being attached to a rear portion of the outer surface of said cushion layer.

11. An improved mop construction as in claim 10 wherein said first, second, and third hook material strips are attached to the outer surface of said cushion layer equidistant about the semi-cylindrical portion opposite the connection means.

12. An improved mop construction as in claim 10 further including a towel or rag having loops on the surface thereof substantially surrounding said mop head and secured thereto solely by direct engagement of said loops with said first, second, and third hook material strips.

* * * * *